United States Patent [19]

Lange

[11] 3,950,051

[45] Apr. 13, 1976

[54] STRUCTURAL MEMBERS FOR FURNITURE ASSEMBLIES

[75] Inventor: Gerd Lange, Kapsweyer, Germany

[73] Assignee: Rudolf Baresel-Bofinger, Ilsfeld, Germany

[22] Filed: July 8, 1974

[21] Appl. No.: 486,354

[30] Foreign Application Priority Data

Mar. 4, 1974 Germany ..... 2410211

[52] U.S. Cl. ..... 312/263; 312/257 R; 403/376

[51] Int. Cl.[2] ..... F16B 12/00; A47B 47/00

[58] Field of Search ..... 312/108, 111, 263, 257; 403/376

[56] References Cited

UNITED STATES PATENTS

| | | | |
|---|---|---|---|
| 3,589,784 | 6/1971 | Winkels | 312/263 |
| 3,594,056 | 7/1971 | Sager | 312/263 |
| 3,835,354 | 9/1974 | Pena | 312/263 |

FOREIGN PATENTS OR APPLICATIONS

| | | | |
|---|---|---|---|
| 80,937 | 5/1963 | France | 312/263 |
| 1,010,069 | 11/1965 | United Kingdom | 312/263 |
| 1,378,237 | 10/1964 | France | 312/263 |

*Primary Examiner*—Casmir A. Nunberg

[57] ABSTRACT

Furniture assemblies comprising at least two sets of elongated structural members adapted to be selectively arranged in a desired combination. The members of one set are provided with longitudinal grooves while the members of the other set are provided with longitudinal tongues adapted to fit in the grooves. Each of the structural members is provided with at least one hole extending perpendicularly through the respective groove and tongues when assembled together. An anchor bolt is provided for joining the members together. The anchor bolt has a head at one end and a shank adapted to extend through the mating holes. The bolt is held by locking means which removably engage the shank of the bolt and secure the bolt under tension within the hole. The locking means comprises an eccentric bushing adapted to fit in the blind bore and engage the wall of the bore as it pulls on the shank of the bolt. Further sets of wall and/or shelf members are provided each formed with a tongue or groove adapted to mate with the members of the first two sets.

17 Claims, 11 Drawing Figures

STRUCTURAL MEMBERS FOR FURNITURE ASSEMBLIES

BACKGROUND OF THE INVENTION

The present invention relates to structural members by which combinations of furniture or similar unit systems can be constructed and in particular to the supporting structural members for different articles of furniture such as for instance tables, chairs, cupboards, wardrobes, shelvings and bookcases.

It is the object of the present invention to provide a combination of structural supporting members for "knock-down" or "do-it-yourself" furniture items which have a pleasing design and which may be rapidly and easily assembled or disassembled without any special skill or tools required.

It is a further object of the present invention to provide vertical and horizontal structural supports for furniture items of the type described which may be assembled in any desired combination and to also povide corresponding base plates, table tops, shelves and wall structural units as may be necessary to complete the furniture item so assembled. The foregoing objects, other objects as well as numerous advantages of the present invention will be apparent from the following disclosure.

SUMMARY OF THE INVENTION

According to the present invention the easily assembled and disassembled furniture units of the type described are formed from two sets of elongated structural members which may be selectively arranged in any desired combination. The members of one set is provided with at least one longitudinal groove along its surface while the members of the other set are provided with at least one longitudinal tongue adapted to fit into the groove. Each of the structural members is provided with at least one hole extending perpendicularly through the respective groove and tongue to form a mating elongated hole when so assembled. The members are then joined together by anchor bolts which have a head at one end and an elongated shank adapted to be received in the mating holes and to extend freely through the groove and tongue. Locking means are provided for removably engaging the shank of the bolt and securing the bolt within the holes under tension thereby locking the assembled members together.

Preferably the locking means comprises an eccentric bush which is adapted to fit within a blind bore formed in at leat one of the structural members. The eccentric bush is adapted to be rotated and thereby engage the wall of the blind bore reacting therewith to pull the shank tightly.

One of the sets of structural members comprises a vertical support. Preferably the vertical support is provided with a longitudinal groove. The other set cmprises horizontal supports which are preferably provided with the correspondingly formed tongues. Preferably the anchor bolts are arranged to pass first through the vertical support and have its shank extend within the horizontal support. Preferably the horizontal support is thus provided with a blind bore receiving the eccentric bush.

Further, it is preferred that the vertical supports be provided with a plurality of holes uniformly spaced along its length so that the horizontal support can be spaced, as selected, along the length of the vertical support. In this manner the horizontal support need be provided with only one mating hole and with one blind bore for receiving the eccentric bush. The blind bore extends perpendicularly to the hole receiving the bolt shank and communicates therewith so as to allow the bush to engage the shank.

Preferably, in accordance with the present invention, the horizontal supports have in addition to the longitudinal tongue, a longitudinal groove formed on opposite sides. The longitudinal grooves formed in the horizontal supports are adapted to receive members of yet a third set of structural elements, namely elements comprising baseboards, tabletops, shelf members, or wall panels according to the nature of the furniture unit being assembled.

In addition, wall panels are provided which can be used to form vertical walls or partitions. The wall panels are provided on at least a pair of its opposite edges with perpendicular holes and blind bores for connection with the vertical supports in a similar manner to that of the horizontal supports.

In accordance with the present invention the eccentric bushes comprise a generally disc-like member having a slot formed in its peripheral edge extending radially inward between its opposed faces. The slot is provided with two parallel eccentrically flanged tips which are adapted to engage a collar formed at the end of the shank of the anchor bolt. The bushes are rotatable so that the eccentrically flanged tips engage over and pull the collar of the anchor bolt.

Full details of the present invention are given in the following description of the its preferred embodiments and will be seen in the accompanying drawings to which reference is made.

DESCRIPTION OF THE INVENTION

Figure 1:
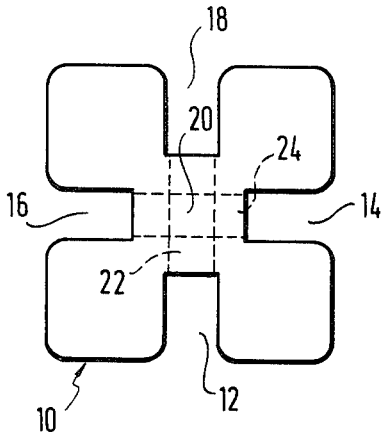
FIG. 1 is an end view of an elongated vertical support member.
Figure 2:
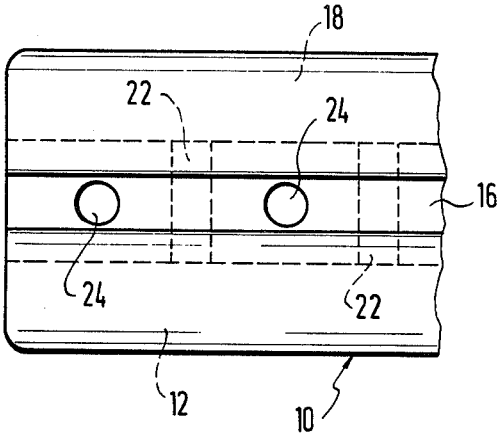
FIG. 2 is a side view of the vertical support member seen in FIG. 1.

In FIGS. 1 and 2 a vertical support generally depicted by the numeral 10 is shown. The vertical support 10 comprises an elongated bar or rail member having a generally square cross section although as will be obvious it may have a rectangular or other polygonal shape. As seen in FIGS. 1 and 2 each of the longitudinal surfaces of the vertical support 10 is provided with a longitudinal groove 12, 14, 16 and 18 respectively. The grooves are arranged at an angle of 90° to one another and terminate a substantial distance from the longitudinal center of the support so as to leave a solid core 20.

Two sets of holes 22 and 24 are drilled through the core 20 alternately with each other and at uniformly spaced intervals. The set of holes 22 extend completely through the core between the grooves 12 and 18 while the set of holes 24 extend fully through the core 20 between the grooves 14 and 16. Thus the holes 22 are perpendicularly offset from the holes 24 while each of the holes 22 and 24 extend perpendicularly to the longitudinal axis of the vertical support 10, as more clearly seen in FIG. 2. It will be obvious that the holes 22 are spaced half distance between the holes 24.

Figure 3:
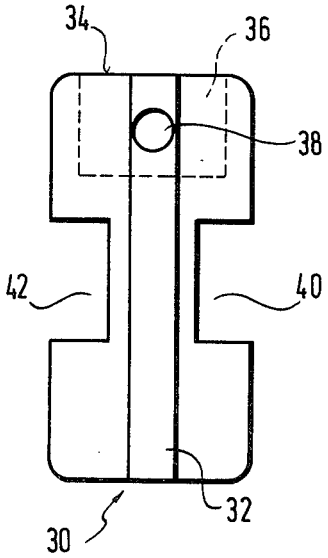
FIG. 3 is an end view of a horizontal support member.
Figure 4:
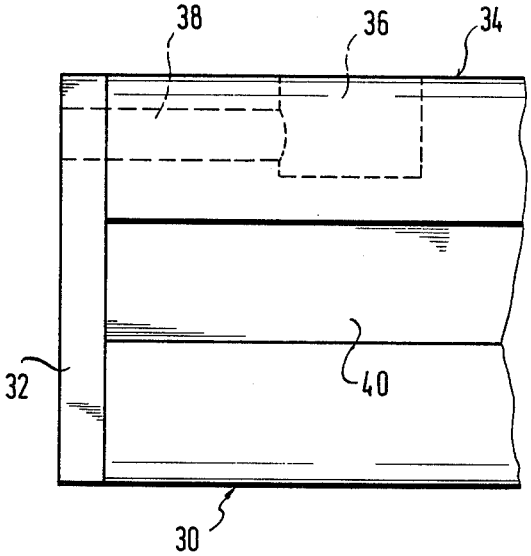
FIG. 4 is a side view of the horizontal support shown in FIG. 3.

As seen in FIGS. 3 and 4 the horizontal support, generally depicted by the numeral 30 comprises an elongated member of generally rectangular shape although it too may assume another cross sectional configuration if desired. The horizontal support 30 is provided at at least one of its ends with a transverse tongue 32 which extends from one edge surface 34 to its opposite edge surface. The tongue 32 is arranged along the central transverse axis of the horizontal support 30 and is of a depth and width mating with any one of the longitudinal grooves 12, 14, 16 and 18 formed in the vertical support 10. The tongue 32 is adapted to be received in any one of these longitudinal grooves with a slight degree of sliding movement and because of its location along the central transverse axis of the horizontal support 30 enables the support 30 to lie symmetrically to the longitudinal mid-plane of the support 10. The horizontal support 30 is provided with a blind bore 36 which extends from the upper edge surface 34 transversely inwardly toward the center of the support 30. The blind bore 36 is preferably of cylindrical shape and is offset axially from the end of the support having the tongue 32. An axial bore 38 extends through the tongue 32 into the support 30 and terminates in communication with the blind bore 36. The hole 38 is preferably symmetrical to the longitudinal central plane of the support. Moreover, the horizontal support 30 is provided along its opposite side surfaces with longitudinally extended grooves 40 and 42. The grooves 40 and 42 preferably extend along the length of the horizontal support 30 although this may not be always necessary and are adapted and serve to receive an additional structural unit as will be further explained.

Figure 5:
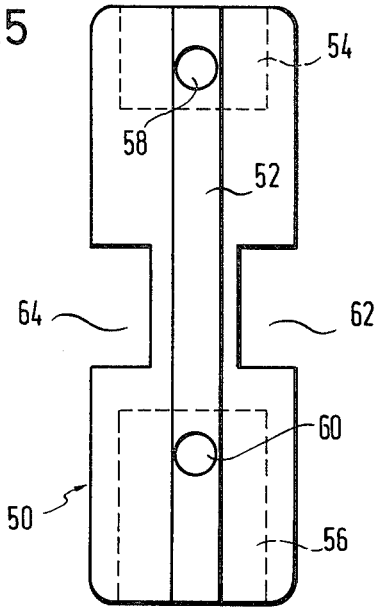
FIG. 5 is an end view of a second form of horizontal support.
Figure 6:
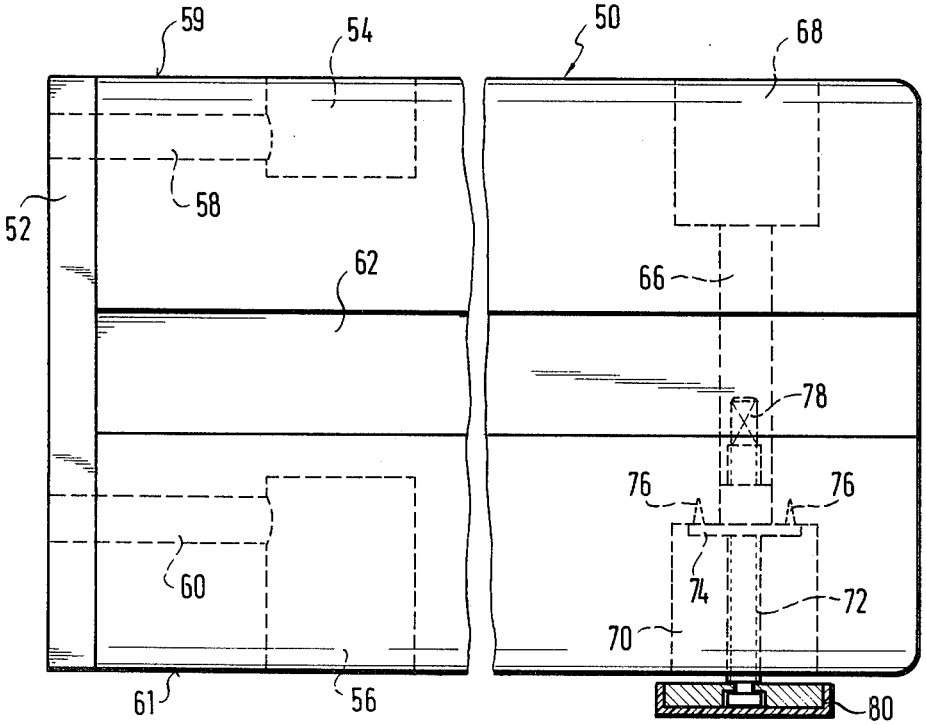
FIG. 6 is a side view of the horizontal support seen in FIG. 5 showing a supporting foot member arranged therein.

In FIG. 5 and 6 a further form of a horizontal support is shown. In these figures the horizontal support, generally depicted by the numeral 30 in much the same way as the previously described horizontal support 30 but has larger dimensions than the latter. Like the support 30 the horizontal support 50 also is provided with a blind bore 54 which extends from the upper narrow longitudinal side 59 and is also preferably of cylindrical shape. The support 50 is moreover provided with an axially extending tongue 52 along its central transverse plane from the upper surface 59 to the lower surface 61. A hole 58 extends through the tongue 52 axially parallel to the central longitudinal axis and terminates within the blind bore 54. Unlike the previously described horizontal support 30, the horizontal support 50 seen in FIGS. 5 and 6 is provided with an additional blind hole 56 which extends from the bottom longitudinal side opposite to that of the first blind bore 54. The second blind bore 56 is made deeper than the first although transversely aligned with it. A second hole 60 running parallel to the hole 58 is provided extending through the tongue 52 into the blind bore 56. The hole 60 is set so that it enters the bore 56 substantially adjacent its bottom so that its distance from the surface 61 is greater than the distance of the hole 58 from the upper surface 59. The broad side surfaces of the horizontal support 60 is similarly to that of the support 30 previously described, provided with longitudinally extending grooves 62 and 64 which receive additional supporting members.

The horizontal support 50 shown in FIG. 6 is provided at its end opposite the end at which the tongue 52 is provided, with a bore 66 which extends through its entire height from the upper surface 59 through to the lower surface 61. The bore 66 has a widened upper portion 68 and a similarly widened lower portion 70 extending from the surfaces 59 and 61 respectively. The widened portions 68 and 70 provide shoulders set within the horizontal support member 50 and serve to receive an adjustable foot member comprising a screw 72 adapted to be received within a threaded supporting ring 74 which is secured to the shoulder of the widened portions 68 or 70 by a plurality of claws or prongs 76. The prongs 76 are pressed into the material of the horizontal support 50 and thus hold the supporting ring 70 securely. The supporting ring 74 thus lies on the bottom surface or shoulder of the drillings 68 or 70 (70 as shown in the drawing). The screw 72 has a head 77 over which is placed in a loose and rotatable manner a plastic cap 80. The plastic cap 80 is snapped over the head 77 and is provided with means to enable its retention on the head 77. The free end of the screw 72 is provided with a landed or squared end 78 which provides a nut enabling the screw 72 to be turned with a suitable tool. The tool will extend through the drillings 68 and the hole 66 into engagement with the nut end 78. In this manner the height of the screw 72 extending from the bottom surface 61 of the horizontal support member 50 may be adjusted by rotating the screw 72 relative to the threaded support ring 74. In this manner the support 50 can be used as a base or foot member.

Figure 7:
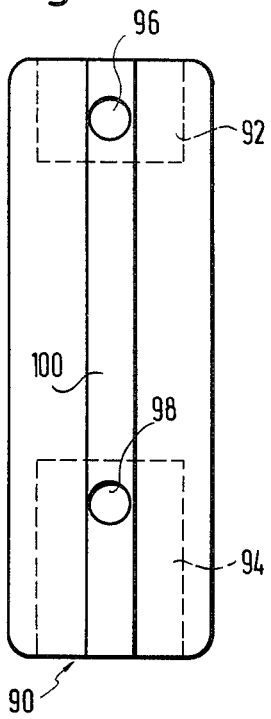
FIG. 7 is an end view of a wall panel.
Figure 8:
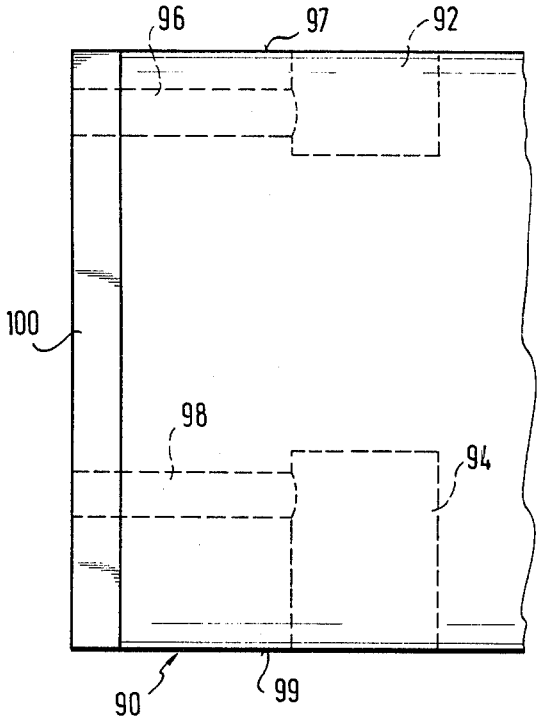
FIG. 8 is a side view of the wall panel shown in FIG. 7.

In FIGS. 7 and 8 a wall panel 90 is shown. The wall panel 90 comprises a board-like or sheet member having a rectangular cross section and an elongated length. The wall panel 90 is formed at both of its ends (although one is shown in the figures) in a manner similar to the construction of the horizontal base support shown in FIG. 6, in that it is provided with a tongue 100 lying along the longitudinal central plane extending throughout the height of the bore from its upper surface 97 to its lower surface 99 and blind bores 92 and 94 together with axially aligned holes 96 and 98. The blind bore 92 starts from the upper surface 97 while the blind bore 94 starts from the lower surface 99. The blind bore 94 is deeper than the blind bore 92. The holes 96 and 98 extend through the tongue 100 and are axially aligned along the central longitudinal plane and extend through to the bores 92 and 94. The holes 96 and 98 are spaced from their respectively associated surfaces 97 and 99 so as to enter into the lower portion of the bores 92 and 94 respectively. Thus the hole 98 lies at a greater distance from the surface 99 than does the hole 96 from the surface 97. Unlike the horizontal base support shown in FIG. 6, the wall panel 90 shown in FIGS. 7 and 8 is symmetrically formed at each of its ends, i.e. each of its ends has correspondingly and suitably arranged blind bores 92 and 94, longitudinal holes 96 and 98 and a tongue 100.

Figure 9:
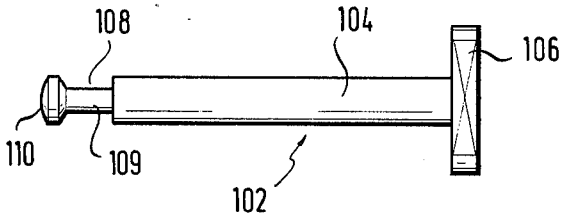
FIG. 9 is a plan view of an anchor bolt.

An anchor bolt, generally depicted by the numeral 102, by which the individual vertical, horizontal and wall panel support elements are connected together is shown in side view in FIG. 9. The anchor bolt 102 comprises a cylindrical shank 104 having an integral head 106 formed at one end. At the end of the shank opposite the head 106 a portion 108 is removed leaving a narrow shank portion 109 terminating in an annular collar 110. The head 106 is of rectangular shape (the height being visible in FIG. 9) having a width (not visible in FIG. 9) corresponding to the width of either one of grooves 12, 14, 16 or 18 of the vertical support member 10. The head 106 of the anchor bolt is adapted to be received within any one of the grooves and because of its height and conforming width to the groove be seated therein against rotation. The depth of the head 106 should of course conform to the depth of the grooves so as not to extend outwardly from the groove. The shank portion 102 of the anchor bolt will have a length conforming to the combined length of either the holes 22 or 24 and the mating holes 96 and 98 so that when inserted through these mating holes the narrowed shank portion and head 10 extend within the bore 92 or 94. For certain applications the anchor bolt 102 may be provided with the neck down narrowed shank portion 109 and the collar 110 at each of its ends rather than with a head 106 at one end.

Figure 10:
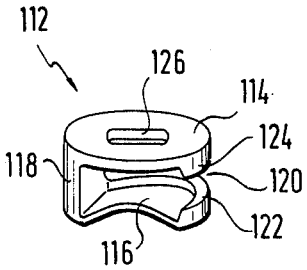
FIG. 10 is a perspective view of an eccentric locking bush.

FIG. 10 shows the locking means used in association with the bolt 102. The locking means comprises an eccentric bush 112 which is formed in the shape of a rotatable socket having an upper disc member 114 and a lower disc member 116 joined together by a solid webbing 118 along a portion of its periphery. Preferably the bush 112 is formed as a unitary member and the webbing 118 joins the discs 114 and 116 with a degree of resiliency. Integrally formed with the interior surface of each of the discs 114 and 116 along their peripheral edge opposite to that of the web 118 is an eccentric radially inwardly extending tip or flange 122 and 124 respectively. The flanges 122 and 124 extend from one edge of the webbing 118 circumferentially around the peripheral edges of the discs 114 and 116 to a point spaced from the opposite edge of the web 118. This leaves an enlarged opening seen in front of the bushing as depicted in FIG. 10 into which the collar 110 of the anchor bolt 102 is adapted to be received and an arcuate slot 120 or gap between the flanges 122 and 124 to receive the narrowed shank 109 of the bolt. The gap 120 is axially wide at the frontal opening of the bushing 112 as seen in FIG. 10 and narrows so that the flanges 122 and 124 move toward each other as they curve about the periphery of the bushing. In addition each of the flanges 122 and 124 widen radially inwards toward the axial center of the bush as they curve in the peripheral direction. Thus, on entry of the collar 110 within the bushing 112, the collar 110 rides against the interior rail-like surfaces of each of the flanges 122 and 124 causing the bolt to be pulled radially inwardly with respect to the circumference of the bushing. The upper disc 114 of the bushing 112 is provided with a slot 126 into which a tool such as a screwdriver or the like may be inserted thereby permitting the bushing 112 to be rotated about its central axis.

Figure 11:
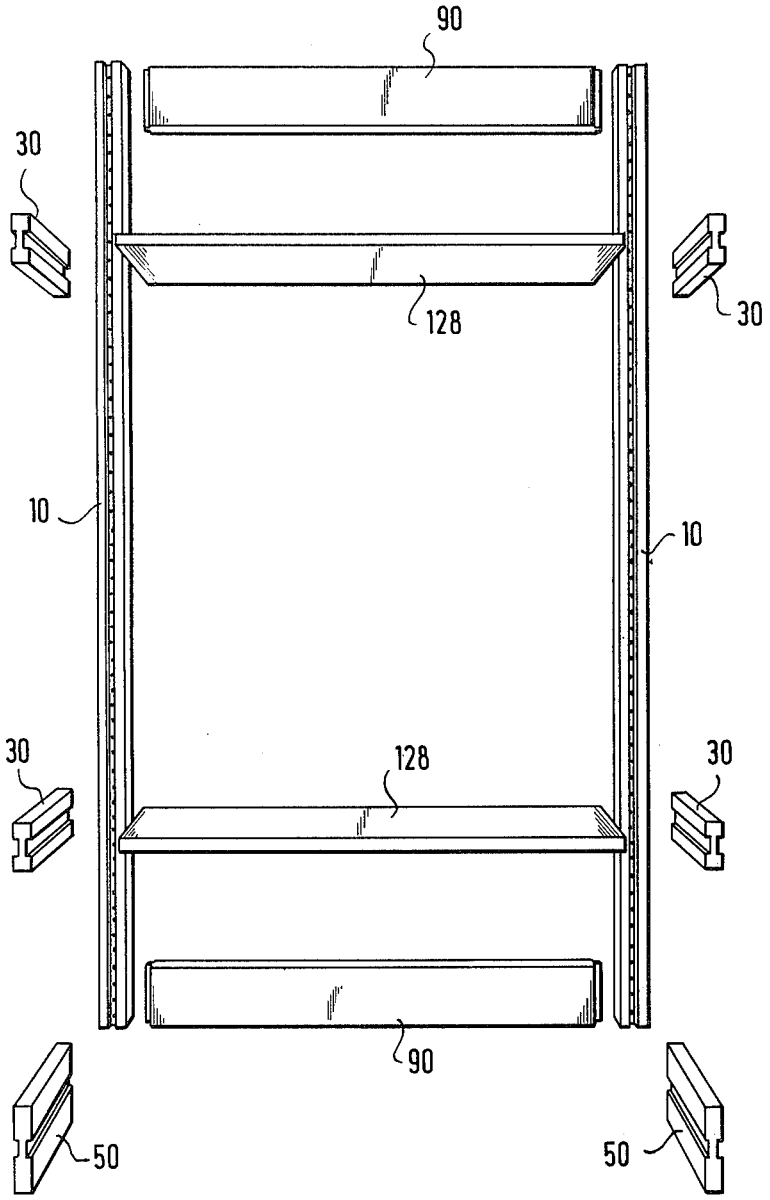
FIG. 11 is an exploded view of a book shelf comprising the structural units of the present invention illustrating the assembly of the structural elements in at least one furniture unit.

An example of the type of furniture unit that can be assembled employing the structural elements of the present invention, and in addition an example of the method by which such units are assembled is illustrated in the exploded view of FIG. 11. The furniture unit actually shown in FIG. 11 is a book shelf or bookcase constructed from a pair of vertical supports 10, two or more pairs of horizontal supports 30, in whose lateral grooves 40 or 42 are slidably inserted horizontal shelf members 128. Horizontal base support members 50 are attached to the lower ends of the vertical supports 10 and act as supporting stabilizing feet for the bookcase unit. The horizontal base support members 50 may be provided with the adjustable feet shown in FIG. 6 and also with a shelf member slidably inserted in their grooves 62, 64. Finally, the unit is completed with one or more back wall panels 90.

It will be noted from FIGS. 1 and 3 that the horizontal support member 30 is somewhat narrower than the vertical support member 10 and has its tongue along the central plane. Thus, when the tongue 32 is inserted in any one of the grooves of the vertical member 10 the horizontal support is symmetrical to the central plane of the vertical member 10 and a small overlapping of the surface of the vertical member 10 occurs to either side of the horizontal members. Thus when the horizontal shelf members 128 are slidably inserted within the grooves of the horizontal support members 30 they are slid until they abut against the overlapping edges of the vertical support thus placing the shelf member 128 securely in place. It will also be observed that in the construction shown in FIG. 11 the horizontal support members 30 are provided with tongues at only one end and thus extend cantilevered from the vertical support members 10. The actual support of the bookcase or book shelves as indicated in FIG. 11 is obtained by resting the horizontal base support members 50 with or without the feet 80 on the floor. The elements, vertical supports, horizontal supports, shelf members and back panel members shown in FIG. 11 may be formed of any suitable material such as wood, plastic, metal or the like customarily used in the formation of furniture of this type.

It will be obvious that only minor modification of the arrangement shown in FIG. 11 need be made in order to produce other furniture units, enclosed book shelves can be obtained by utilizing wall panel members not only for the back but also for the sides and that instead of merely using two vertical supports four or more vertical supports may be used in a box-like arrangement. The front of the furniture unit may be enclosed as well by panel members such as the wall panel 90 or panel members which are provided with doors, slides or other constructions well known. Several units may be assembled together, the number of vertical supports, horizontal supports and other items being left as desired for the creation of any piece of wall furniture.

In returning to FIG. 11 the assembly of these units can be carried out as follows. In assembling a horizontal support member 30 to a vertical support member 10 the tongue 32 of the horizontal support 30 is slid into one of the grooves, for instance groove 14, of the support shown in FIG. 1. The horizontal support 30 is placed at the height desired and its hole 38 aligned with the hole 24 in the vertical support. Thereafter, an anchor bolt 102 as shown in FIG. 9 is inserted through the hole 24 from the opposite groove 16 and passes through the hole 38 until its collared end 110 and reduced shank 109 enter into the blind bore 36. The head 106 of the anchor bolt 102, being somewhat less in width than the width of the groove 116 lies largely against the bottom of the groove 60 and is thus hidden therein. The collared end of the bolt 102 protrudes into the blind bore 36 of the support 30 and an eccentric bush 112, seen in FIG. 10, is inserted therein. The dimensions of the bush are such that the collar 110 of the anchor bolt 102 enters in the wide space between the discs 102 and 114 which are urged normally toward each other by the resilient nature of the web 118 joining them. A portion of the reduced shank 109 also protrudes into the space between the discs 114 and 116 of the bushing so that the gap 120 between these portions will in part overlie the narrow shank portion 109. The eccentric bush 112 is thereafter rotated, for instance by means of an ordinary screwdriver, clockwise in the embodiment shown so that the eccentric flange tips 122 and 124 are caused to engage behind the collar 110 and the reduced portion 109 is caused to lie in the gap 120 created between the eccentric flange portions 122 and 124. The dimensions are also such that in this condition the peripheral edge or circumferential surface of the bushing 112 slidably contacts the wall of the blind bore 36. Preferably the bushing 112 is made of a diameter only slightly smaller than that of the blind bore 36. Thus, the rotation of the eccentric bushing 112 reacts against both the collar 110 and the surfaces of the blind bore 36 consequently drawing the anchor bolt 102 inwardly toward the blind bore 36. This pulls the bolt 102 causing its head 106 to pull the vertical support firmly against the horizontal support and places the bolt under sufficient tension to lock the vertical and horizontal supports firmly together. The horizontal member is easily removable and disassembled from the vertical member by counter-rotating the locking eccentric bushing 112 and removing the anchor bolt 102.

A single vertical support 10 may be used to carry a pair of horizontal supports 30 in opposite directions from each other and at the same level. To accomplish this an anchor bolt is used which has a collar 110 and a reduced shank portion 109 at both of its ends rather than at only one end and which is correspondingly longer so that when placed through the hole 24 will protrude through the opposite grooves 14 and 16, for example, into the blind bores 36 of a pair of horizontal supports 30 arranged at the same level. An eccentric bushing is used in each of the blind bores 36 of the opposing horizontal support members 30 and thus tend to place the single anchor bolt having collars at both ends under tension by pulling on the bolt from opposite directions.

Because of the interlocking arrangement created by the tongue and grooves of the respective supports, the supports need only be joined together by a single anchor bolt. However, should additional joining forces be required a horizontal support member having opposed holes and blind bores such as that shown in FIGS. 5 and 6 or 7 and 8 can be used.

The wall panels 90 are connected to the vertical supports 10 in the same way as the horizontal supports 30 were connected thereto. However, each wall panel 90 is provided at both its ends with a tongue 100 and therefore requires two eccentric bushes 112 arranged in the respective bores 92 and 93 so as to join it to each of the opposed vertical panels 10.

The horizontal base supports 50 are as indicated previously designed in principal just like the horizontal support members 30 with the exception that they are provided with a pair of opposed bores 54 and 56 each having a respective axial hole 58 and 60. While the bottom hole 60 in the horizontal base support 50 is spaced at a greater distance from the bottom edge 61 than the hole 58 spaced from the upper edge 59 the distance between the holes 58 and 60 are in a multiple of distances between adjacent holes 22 or 24 of the same set. Therefore, in connecting the base supports 50 to the vertical supports 10 two anchor bolts and two eccentric bushes are used to provide a more rigid and secure fastening of the horizontal base support to the vertical member consonant with their use as supporting feet for the furniture structure. These horizontal base supports 50 as previously explained are provided at their lower ends with adjustable screw feet 72 so that the unit may be levelled on its supported flooring. The base supports 50 are somewhat larger in dimension than those of the horizontal supports 30 and they may be suitably provided with reinforcements or with a reinforced construction so that they may be more suitable as base members. The horizontal base support members 50 are also provided with longitudinal grooves which are adapted to slidably receive a shelf member 128 or the like. The shelf member 128 may be provided with a compartmented construction or a draw-like construction if desired but not shown herein.

It is to be noted from FIG. 6 that the support 50 is provided with a blind bore 54 which is less deep than its opposite blind bore 56. Consequently the hole 58 is at a lesser distance from the surface 59 than the hole 60 is from the surface 61. As noted previously, however, the distance between the respective holes themselves is equal to a multiple between the same holes 22 or 24 in each set formed in the vertical support member 10. (The same relationship holds for the blind bores and holes of the panel members 90, according to FIGS. 7 and 8.) Thus, when a base support 50 is connected to the vertical support 10 its tongue is held in one of the grooves by means of two anchor bolts which pass through parallel holes of the same set as for example if the tongue is retained in groove 14 it passes through similarly directed holes 24. However, if a second horizontal base support 50 is to be connected to the vertical support 10 at right angles to the first base support and at the same height, certain arrangements must be made since at right angles, the holes for the anchor bolts, securing the second horizontal base support 50, are offset between the holes used for the anchor bolts securing the first horizontal base support. Thus in the example if the second base support is to be inserted within the groove 12, thus being at right angles to the first base support, the anchor bolts must pass through the holes 22 formed in the vertical support 10. These holes 22 are offset midway between the drillings 24 previously used. This circumstance, consequently does not permit the arrangement of the two perpendicular base supports at the same level since in order to mate the holes 58 and 60 with the respective holes 22 the upper edge 59 and the bottom edge of the second horizontal base support will be offset from the corresponding upper and bottom edges of the first horizontal base support. However, this problem can be easily overcome by forming the horizontal base support members 50 so that the difference in depth of the blind bores 54 and 56 and consequently the difference in the distance of the holes 58 and 60 from the respective end surfaces 59 and 61 to be exactly half the distance between the corresponding holes 22 or 24 in each of the set of holes in the vertical support 10. This difference corresponds exactly to the difference between the adjacent holes 22 and 24 perpendicularly offset to each other. In this way two horizontal base supports can be aligned with respect to one another at right angles to each other by merely turning one of the horizontal base supports over so that what has been described as the upper edge 59 will become the bottom edge and what has been described as the bottom edge 61 will become the upper edge. The foot member 80 can be easily reversed from the enlarged bore 70 to the enlarged bore 68 shown in FIG. 6. Thus, if two horizontal base members of the type shown in FIG. 6 were employed it would appear as if one member is turned upside down and laid on top of the other so that the hole 58 of one and the hole 60 of the other would be adjacent the same bottom edge but spaced from each other by the distance between adjacent perpendicular bores 22 and 24.

As indicated above, the structural elements of the present invention may be preferably made from wood although other materials such as plastics, metal and the like may also be used. Various modifications and changes have also been suggested in the disclosure as well as various forms and combinations to which such structural elements can be put. It is intended therefore that the present disclosure be taken as illustrative only of the invention and not as limiting in its scope.

What is claimed is:

1. A construction assembly comprising a plurality of elements which coact in combination with each other for the formation of articles of furniture such as tables, chairs, cupboards, wardrobes, shelves and the like, comprising a pair of sets of elongated structural members selectively arranged in said combination, the members of one set having longitudinal grooves, the members of the other set having longitudinal tongues adapted to fit in said groove, each of said structural members having at least one hole extending perpendicularly through said respective groove and tongue to form a mating pair, said members being joined together by an anchor bolt having a shank adapted to be received in said mating pair of holes and to extend freely through said groove and tongue and a rotatable bushing seated within the end of the mating pair of holes removably engaging the end of said shank said bushing being rotatable about an eccentric axis against the wall of said holes to axially pull on said shank securing said bolt within said holes under tension thereby locking said members together.

2. The construction according to claim 1 wherein the members of at least one of said sets is provided with a blind bore extending perpendicularly into communication with the hole therein for receiving said bushing.

3. The construction according to claim 1 including a third set of structural members, the members of said third set comprising a planar wall selectively provided along opposite edges with a tongue or groove adapted to selectively mate with the members of another set.

4. The system according to claim 1 wherein said bolt is provided with a collar at one end and said locking member comprises a rotatable bushing having an eccentric cam surface slidably engaging and holding said collar against the bore and said bolt to draw the same.

5. The system according to claim 4 wherein said anchoring bolt has an integral head formed at one end thereof opposite said collar.

6. The system according to claim 4 wherein said anchoring bolt has a collar at each of its ends held by a bushing.

7. The system according to claim 4 wherein said bushing comprises a pair of disc-like members held together in parallel coaxial arrangement by a web attached along a portion of the periphery of said discs, said discs being spaced from each other to form a gap therebetween and being provided along a portion of its periphery with radially inwardly extending flange surfaces having an arcuate cam configuration, said cam configuration adapted to slidably engage said collar of the anchoring bolt.

8. A construction assembly comprising a plurality of elements which coact in combination with each other for the construction of furniture articles such as tables, chairs, cupboards, wardrobes, bookcases, shelves and the like, said elements including vertical and horizontal supports which are respectively provided with longitudinal grooves and tongues, the tongues of said horizontal support fitting into the grooves of said vertical supports and the supports being provided with holes which receive anchor bolts which are locked in said openings by bushings which join said supports in cooperating relationship with each other said bushings and said anchor bolts having cooperating slidable keying means, said bushing being rotatable about an eccentric axis in engagement with said support to exert an axial pulley action on said bolts to place said bolts under tension.

9. The construction assembly according to claim 8 wherein the horizontal supports are provided with longitudinal grooves adapted to slidably support the edges of planar elements of the furniture article being constructed.

10. The construction assembly according to claim 8 wherein the holes in the vertical supports are continuous and there is at least one blind bore formed in the horizontal support for said bushing and a continuous hole running transversely to said blind bore for said bolt.

11. The construction assembly according to claim 10 wherein said anchor bolts are received in the continuous holes of the vertical support, proceed through the continuous holes in the horizontal support and terminate within the blind bores formed in the horizontal supports, and said bushings are disposed in said blind bores.

12. The construction assembly according to claim 11 wherein the holes in the horizontal supports pass through the tongues thereof.

13. The construction assembly according to claim 9 wherein the grooves for receiving the planar elements of the articles being constructed are on the longitudinal sides of the horizontal supports.

14. A construction assembly according to claim 1 including planar wall members having tongues at each of its ends adapted to be received within the grooves of said vertical members and being provided with openings adapted to receive said anchor bolts.

15. The construction assembly according to claim 8 including a horizontal base support member having a tongue at one end adapted to enter within the grooves of said vertical support and a pair of openings for receiving said anchor bolts extending through said tongues axially inwardly of said panel member and along a common central plane, said pair of openings being spaced from the adjacent edges of said panel member at different distances.

16. The construction according to claim 15 wherein the vertical supports are provided with two sets of openings therein, the openings of each set running parallel to each other and at uniform distances, the openings of one set being offset perpendicularly with respect to the openings of the other set and being located between adjacent holes of one set.

17. The construction according to claim 16 wherein the distance between the holes in the base support member is equal to the distance between the holes of the same set in the vertical support member and the distance of one hole in the base support member from its adjacent surface is equal to half the distance between the holes of the same set in the vertical support member and the distance of the other hole in the base support member from its adjacent surface is equal to the distance between holes in the same set of the vertical support member.

* * * * *